United States Patent [19]

Schmitmann

[11] 4,417,171

[45] Nov. 22, 1983

[54] ROTARY ANODE X-RAY TUBE

[75] Inventor: Herbert Schmitmann, Uttenreuth, Fed. Rep. of Germany

[73] Assignee: Siemens Aktiengesellschaft, Berlin & Munich, Fed. Rep. of Germany

[21] Appl. No.: 311,622

[22] Filed: Oct. 15, 1981

[30] Foreign Application Priority Data

Nov. 14, 1980 [DE] Fed. Rep. of Germany ..... 3043046

[51] Int. Cl.[3] ..... H01J 1/10; H01J 61/52

[52] U.S. Cl. ..... 313/16; 378/131; 378/144

[58] Field of Search ..... 378/131, 144; 313/16

[56] References Cited

U.S. PATENT DOCUMENTS

| | | | |
|---|---|---|---|
| 3,836,805 | 9/1974 | Kok | 378/144 |
| 3,878,395 | 4/1975 | Seifert et al. | 250/402 |
| 4,097,759 | 6/1978 | Furbee et al. | 378/144 |
| 4,144,471 | 3/1979 | Hartl | 378/144 |

*Primary Examiner*—David K. Moore
*Assistant Examiner*—Robert E. Wise
*Attorney, Agent, or Firm*—Hill, Van Santen, Steadman & Simpson

[57] ABSTRACT

In an exemplary embodiment, the rotary anode is mounted by magnetic bearings and is provided with an auxiliary device for conducting the anode current to the external power supply. The auxiliary device comprises at least one auxiliary cathode which rotates with the anode and an auxiliary anode which is arranged concentrically to the anode rotary axis on a stationary part. The heating of the auxiliary cathodes can proceed via generator windings which rotate with the rotary anode and associated stationary exciting windings arranged about the x-ray tube. It is also possible to provide for this purpose a rotating transformer whose primary windings externally annularly surrounds the x-ray tube and whose secondary winding is arranged on a rotating anode part.

5 Claims, 1 Drawing Figure

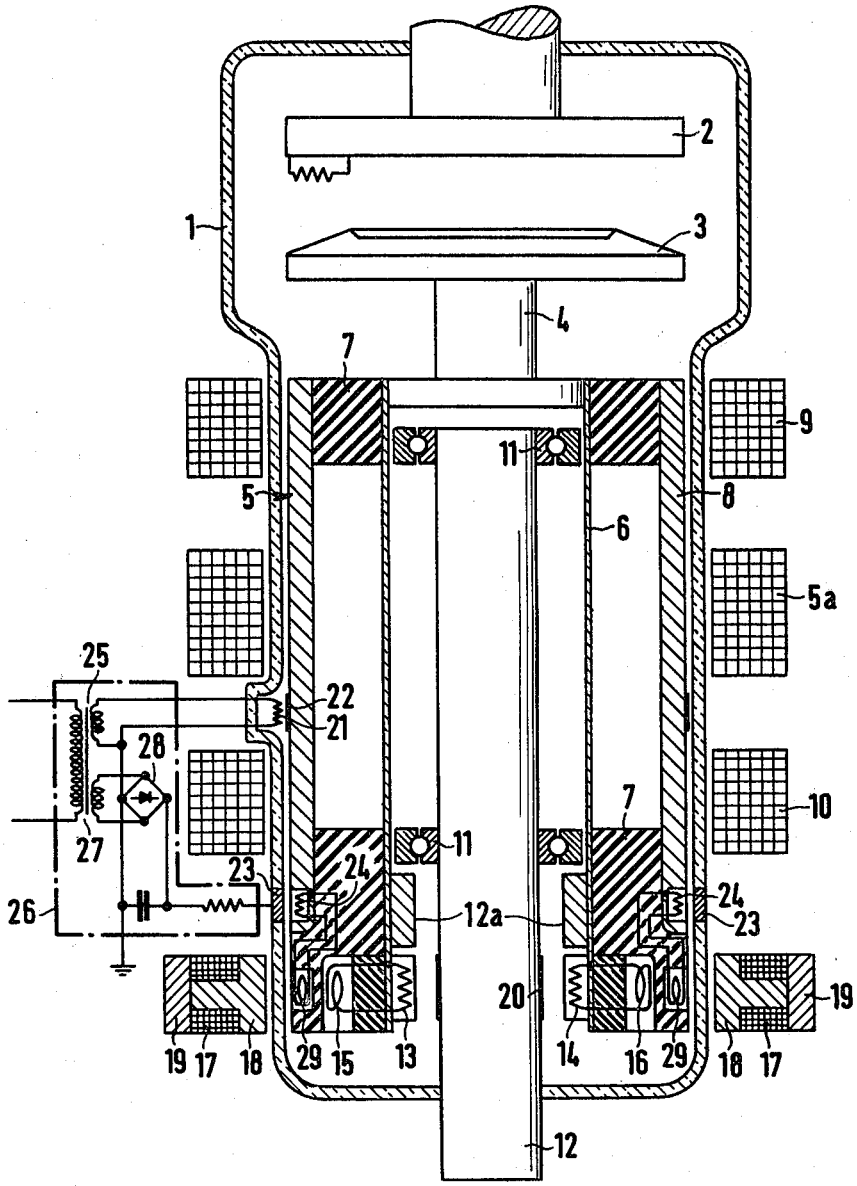
1
2
3
4
5
5a
6
7
8
9
10
11
12
12a
13
14
15
16
17
18
19
20
21
22
23
24
25
26
27
28
29

ROTARY ANODE X-RAY TUBE

BACKGROUND OF THE INVENTION

The invention relates to a rotary anode x-ray tube comprising an anode assembly which is mounted by magnetic bearings and means for conducting current from the rotary anode to a stationary anode supply circuit.

A rotary anode x-ray tube of this type is described in U.S. Pat. No. 3,878,395. In the case of this rotary anode x-ray tube, the anode is supported for rotation by means of a magnetic bearing, which positions the anode assembly axially and radially without contact, the anode assembly drive motor including magnetically-soft material at the part of the anode assembly surrounded by the drive stator for driving the rotary anode, and the tube envelope having further electric windings at the exterior thereof for cooperation with additional magnetically-soft material of the rotary assembly to provide the bearing support for the rotary anode. In the case of this known rotary anode x-ray tube, for the conduction of the anode current, a mechanical contact is provided between a shaft rotating with the anode and a stationary portion. In the case of this contact, brief interruptions can occur which result in sparking. In addition, metal abrasion occurs.

SUMMARY OF THE INVENTION

The object underlying the invention resides in producing a rotary anode x-ray tube of the type initially cited in which the anode current is carried off from the anode without mechanical contact.

This object is achieved in accordance with the invention in that, on a section rotating with the anode, at least one auxillary cathode is arranged, with which an auxiliary anode is associated, which is arranged concentrically to the anode rotary axis on a stationary section. In the case of the inventive rotary anode x-ray tube, the carrying off of the anode current proceeds via an auxiliary diode which is arranged on the anode side; i.e., without mechanical contact.

In accordance with the further development of the invention, in order to heat the auxiliary cathode, generator windings can be arranged on the rotating section with which stationary exciting windings, externally surrounding the x-ray tube, are associated.

The invention shall be explained in greater detail below, on the basis of an exemplary embodiment illustrated on the accompanying drawing sheet; and other objects, features and advantages will be apparent from this detailed disclosure and from the appended claims.

BRIEF DESCRIPTION OF THE DRAWINGS

The single FIGURE is a somewhat diagrammatic longitudinal sectional view of a rotary anode x-ray tube wherein electrical components according to an embodiment of the invention are schematically indicated.

DETAILED DESCRIPTION

In the drawing, 1 designates the evacuated glass envelope of an x-ray tube in which the cathode head 2 and a rotary anode 3 are arranged. The rotary anode 3 is mounted on a shaft 4 which is connected with the rotor 5 of an induction motor. The rotor 5 consists of a metal cylinder 6, insulating layers 7, and an iron cylinder 8. The parts 4, 6, 7, 8, are rigidly interconnected. The rotor 5 is driven by a drive winding 5*a*, and, during its rotation, is kept in suspension by the magnetic bearing windings 9, 10, surrounding a cylindrical portion of the glass envelope 1. Serving as an emergency bearing are two bearings 11 which, during disconnection or failure of the magnetic bearing, prevent the iron cylinder 8 from resting against the interior side of the glass envelope 1 and, together with limit stops 12*a*, prevent too far an axial displacement of the rotating part.

In order to carry off the anode current, in the rear section of the rotor 5, one or more cathodes are provided uniformly distributed over the circumference of the rotor 5, of which two cathodes are visible in the drawing and referenced with 13 and 14. In the illustrated exemplary embodiment, parts 17, 18, 19, represent the stationary section, and windings 15, 16, the rotating section of a generator. The generator accordingly possesses several exciting windings 17, distributed over the circumference of the glass envelope 1, which induce the filament voltage in the generator windings 15, 16, during rotation of the anode and the rotor 5. The exciting windings 17 are arranged between a magnetic pole 18 and an outer ring 19 of magnetically-soft material. For the purpose of contact-free transmission of the heating energy, it is also possible to provide a rotating transformer whose primary winding externally surrounds the x-ray tube in an annular fashion and whose secondary winding is arranged on the rotating anode part.

An annular auxiliary anode 20, arranged on the stationary bearing journal 12, is associated with the auxiliary cathodes 13, 14. It is thereby possible to carry away in a contact-free fashion, the anode current from the x-ray tube via the cathode-anode gaps between each auxiliary cathode 13, 14, respectively, and the auxiliary anode 20. The auxiliary anode 20 surrounds the bearing journal 12 concentrically so that a carrying-off of current during rotation is guaranteed in all angular positions of the anode 3. The carrying-off of current proceeds via the bearing journal 12 which consists of electrically conductive material.

The auxiliary cathodes 13, 14, and the auxiliary anode 20 form secondary diodes. These secondary diodes can be so designed that only a minimum voltage drop occurs and the voltage between the anode 3 and the cathode head 2 is hardly impaired. The heat occurring at the auxiliary anode 20 is carried off via the journal 12. It is also conceivable to design the journal 12 to be hollow and to cause cooling oil to circulate through it.

Between the auxiliary cathodes 13, 14, and the auxiliary cathode 20, a controlled grid can be provided, so that, via the grid bias voltage of this control grid, the voltage drop at the transmission path can be varied and hence the voltage between the anode 3 and the cathode head 2 can be influenced. Since a voltage supply is already provided for the auxiliary cathode 13, 14, (filament voltage), the grid bias voltage can be obtained therefrom. The control of the grid bias voltage can proceed externally by means of a high-frequency transmission path.

The air gap between the magnetic bearing windings 9 and 10 and the iron cylinder 8 is to be kept as small as possible. In order that, during operation with high voltage, no charging of the iron cylinder 8, and hance no spark ever occurs, the iron cylinder 8 is connected to ground potential. For this purpose, two diode paths are provided, the one of which exhibits a cathode 21, support-mounted on the glass envelope 1, and an anode 22 on the iron cylinder 8, and the other exhibits an annular anode 23 sealed in the wall of the glass envelope 1, and one or more cathodes 24, rotating with the iron cylinder 8 and arranged in a recess of the iron cylinder 8. Since the anode 22 is designed annularly, it is also possible for several cathodes 21 to be associated with the latter.

The heating of the cathode 21 proceeds via a filament transformer 25 of a supply circuit 26. The anode voltage for the two diodes 23, 24 associated with the iron cylinder 8 is delivered by an anode voltage tansformer 27 via a rectifier 28. The cathode 21 is connected to ground potential so that also the iron cylinder 8 is virtually connected to ground potential.

The heating of the cathodes 24 proceeds via a generator winding 29 in which the filament voltages are induced by the exciting windings 17 during the rotation of the rotor 5.

It will be apparent that many modifications and variations may be effected without departing from the scope of the novel concepts and teachings of the present invention.

SUPPLEMENTARY DISCUSSION

In the drawing, anode 3 is electrically connected with metal sleeve 6 via the lower disk on shaft 4. The upper ends of filaments 13 and 14 are electrically connected with the sleeve 6 to complete the anode circuit to auxiliary anode 20 and stationary journal 12. The line from the anode high voltage supply (corresponding to the electrical line with reference numeral sixty-three in the first figure of U.S. Pat. No. 3,878,395) would then connect with the stationary journal 12 of the present drawing.

The upper end of each of the filaments 24 is electrically connected with cylinder 8 of magnetic material so that the material of cylinder 8 is connected to ground via the diodes comprised of filaments 24 and annular anode 23.

I claim as my invention:

1. A rotary anode x-ray tube comprising an anode arrangement (3, 4, 5) mounted magnetically for rotation with respect to an anode rotary axis without contact, including an anode (3) and a part (5) rotating with the anode (3), a stationary part (12), and means (12, 13, 14, 20) for carrying off the anode current comprising at least one auxiliary cathode (13, 14) arranged on said part (5) rotating with the anode (3), and an auxiliary anode (20), arranged concentrically to the anode rotary axis on the stationary part (12), and operatively associated with said auxiliary cathode.

2. A rotary anode x-ray tube according to claim 1, characterized in that the stationary part comprises a stationary journal (12), the auxiliary anode (20) is arranged in the form of a ring on the stationary journal (12), the part (5) comprises a hollow-designed rotating anode part (5) surrounding said stationary journal (12), and said stationary journal (12) having emergency bearings (11) for the anode arrangement (3, 4, 5).

3. A rotary anode x-ray tube according to claim 1, characterized in that said means comprises a plurality of auxiliary cathodes (13, 14) having filament windings arranged on the rotating part (5), generator windings (15, 16) connected with the filament windings of the auxiliary cathodes (13, 14) for supplying heating current thereto, and stationary exciting windings (17), externally surrounding the x-ray tube, and coupled with said generator windings (15, 16).

4. A rotary anode x-ray tube according to claim 1, characterized in that, in order to heat the auxiliary cathodes (13, 14) a rotating transformer is provided having a primary winding externally annularly surrounding the x-ray tube and having a secondary winding arranged on the rotating anode part (5).

5. A rotary anode x-ray tube according to claim 1, including an x-ray tube envelope (1), characterized in that the rotating part (5) comprises a cylinder (8) of magnetic material adjacent the x-ray tube envelope (1) and forming a component part of a magnetic bearing for the anode arrangement, said cylinder (8) supporting a further auxiliary anode (22) and a further auxiliary cathode (24), a cooperating cathode (21) on the x-ray tube envelope (1) and cooperating with said further auxiliary anode (22) to form a first diode, and a cooperating anode (23) on the x-ray tube envelope (1) and cooperating with said further auxiliary cathode (24) to form a second diode, said first and second diodes (21, 22; 23, 24) connecting said cylinder (8) to ground potential.

* * * * *